US007553219B1

(12) United States Patent
Rommer

(10) Patent No.: US 7,553,219 B1
(45) Date of Patent: Jun. 30, 2009

(54) LOUVER SANDER

(76) Inventor: Robert James Rommer, 55 Ivy Ridge, Ellijay, GA (US) 30536

( * ) Notice: Subject to any disclaimer, the term of this patent is extended or adjusted under 35 U.S.C. 154(b) by 52 days.

(21) Appl. No.: 11/517,594

(22) Filed: Sep. 8, 2006

(51) Int. Cl.
*B24B 27/08* (2006.01)

(52) U.S. Cl. ..... 451/356; 15/220.3

(58) Field of Classification Search ..... 451/344, 451/351, 356, 357, 359, 414, 456; D8/61, D8/62; 81/54, 57; 15/220.3
See application file for complete search history.

(56) References Cited

U.S. PATENT DOCUMENTS 1,570,177 A * 1/1926 Pointer ..... 451/495
2,571,906 A * 10/1951 Love ..... 15/220.3
2,957,190 A * 10/1960 Stark ..... 15/121
3,640,031 A * 2/1972 Descant ..... 451/522
4,085,478 A * 4/1978 Bailes et al. ..... 15/245
4,279,103 A * 7/1981 Rodarte ..... 451/522
4,468,833 A * 9/1984 Samuelsson ..... 15/245
4,483,037 A * 11/1984 Jacobson ..... 15/220.3
5,293,156 A * 3/1994 Shoji et al. ..... 340/636.1
5,437,571 A * 8/1995 Everts et al. ..... 451/344
5,554,066 A * 9/1996 Bosten et al. ..... 451/356
D377,892 S * 2/1997 Sung ..... D8/62
5,851,141 A * 12/1998 Elmore ..... 451/357
6,641,467 B1 * 11/2003 Robson et al. ..... 451/334

* cited by examiner

*Primary Examiner*—Maurina Rachuba
(74) *Attorney, Agent, or Firm*—Thomas, Kayden, Horstemeyer & Risley, LLP.

(57) ABSTRACT

A representative louver sander includes: a housing containing a vibrator motor; and a sanding attachment having a staff and a sanding paddle, the staff being sized and shaped to be removably attached to the housing, the sanding paddle being located at a distal end of the staff such that when the staff is attached to the housing and the vibrator motor is operating, the sanding paddle is vibrated; the sanding paddle having first and second opposing sanding surfaces and a curved surface interconnecting the first and second surfaces; the first sanding surface extending outwardly from the curved surface to a length that is greater than a length that the second sanding surface extends from the curved surface.

12 Claims, 2 Drawing Sheets

LOUVER SANDER

BACKGROUND

Windows are your view to the world and window treatments add aesthetic appeal to your windows and your rooms. Many windows are covered with louvered shutters which can be adjusted to various angles to allow varying amounts of light to enter or fully closed for privacy. Louver doors are also commonly used as a regular entrance door—frequently in conjunction with a screen door—to allow fresh air to circulate. Although most individuals don't realize it, maintaining good air flow in a home affords more benefits than a refreshing breeze as the indoor quality in homes across the country is more that just comfort related issue, it is a health issue.

Government agencies have reported that 44 million homes in the U.S. have dust mite allergens. This can aggravate existing allergies, or possibly cause them, and contribute to asthma, one of the most common chronic childhood diseases in the U.S. today.

Louver doors are also extensively used for closets and storage spaces because they allow air to circulate which helps to prevent development of mildew and mold—a common problem for small, enclosed areas.

Louver doors and windows are not without drawbacks, however, and cleaning them can be difficult and time consuming. Painting the louvers is an even bigger problem as each individual louver must be cleaned and sanded before applying paint.

The louvers can be cleaned fairly easily using a vacuum cleaner and soft brush attachment but the sanding has to be accomplished the old fashion way—with sandpaper. As can be envisioned, this is a tedious and time-consuming task.

SUMMARY

An embodiment of a louver sander comprises: a housing containing a vibrator motor; and a sanding attachment having a staff and a sanding paddle, the staff being sized and shaped to be removably attached to the housing, the sanding paddle being located at a distal end of the staff such that when the staff is attached to the housing and the vibrator motor is operating, the sanding paddle is vibrated; the sanding paddle having first and second opposing sanding surfaces and a curved surface interconnecting the first and second surfaces; the first sanding surface extending outwardly from the curved surface to a length that is greater than a length that the second sanding surface extends from the curved surface.

DETAILED DESCRIPTION

The Louver Sander would be a compact, battery operated tool which is designed specifically for sanding individual louvers on louver windows and doors. Design intent of the Louver Sander is to make the task of sanding louvers easier and less time consuming.

The Louver Sander would be compact in size and would have approximate dimensions of 12 inches in length and 2½ inches in width. The Louver Sander would be comprised of two separate parts, a battery operated vibrator motor and a detachable sanding paddle. The vibrator motor would be enclosed with a rectangular housing which also provides a storage area or battery compartment, in which replaceable batteries would be inserted. The housing would be made from a sturdy, durable plastic. Operation of the vibrator motor would be controlled by a three speed (on/off), pushbutton switch which is positioned on the front panel of the housing. The switch contacts are wired in series with the batteries' output terminals and are used to apply or remove battery power from the vibrator motor. The holder snap fits into the vibrator motor and would be inserted through an opening on the top of the housing. The holder affords a flat surface with a rounded, lower end which curls back upon itself. The rounded, lower end would be fitted over the outer edge of the louver that would be sanded and would function as retaining guide. The sanding paddles would be made of steel with grips like sandpaper. The housing would be the handle of the tool.

Recognizing that louvers come in various thickness, sanding paddles of different sizes would be made available. The sanding paddle would be completely cleanable and reusable. Eventually they would wear down and need to be replaced. New paddles would be available to purchase individually.

The Louver Sander would be a most useful tool for carpenters, painters, do-it—yourselfers and others and the potential market arena would be sizable.

Figure 1:
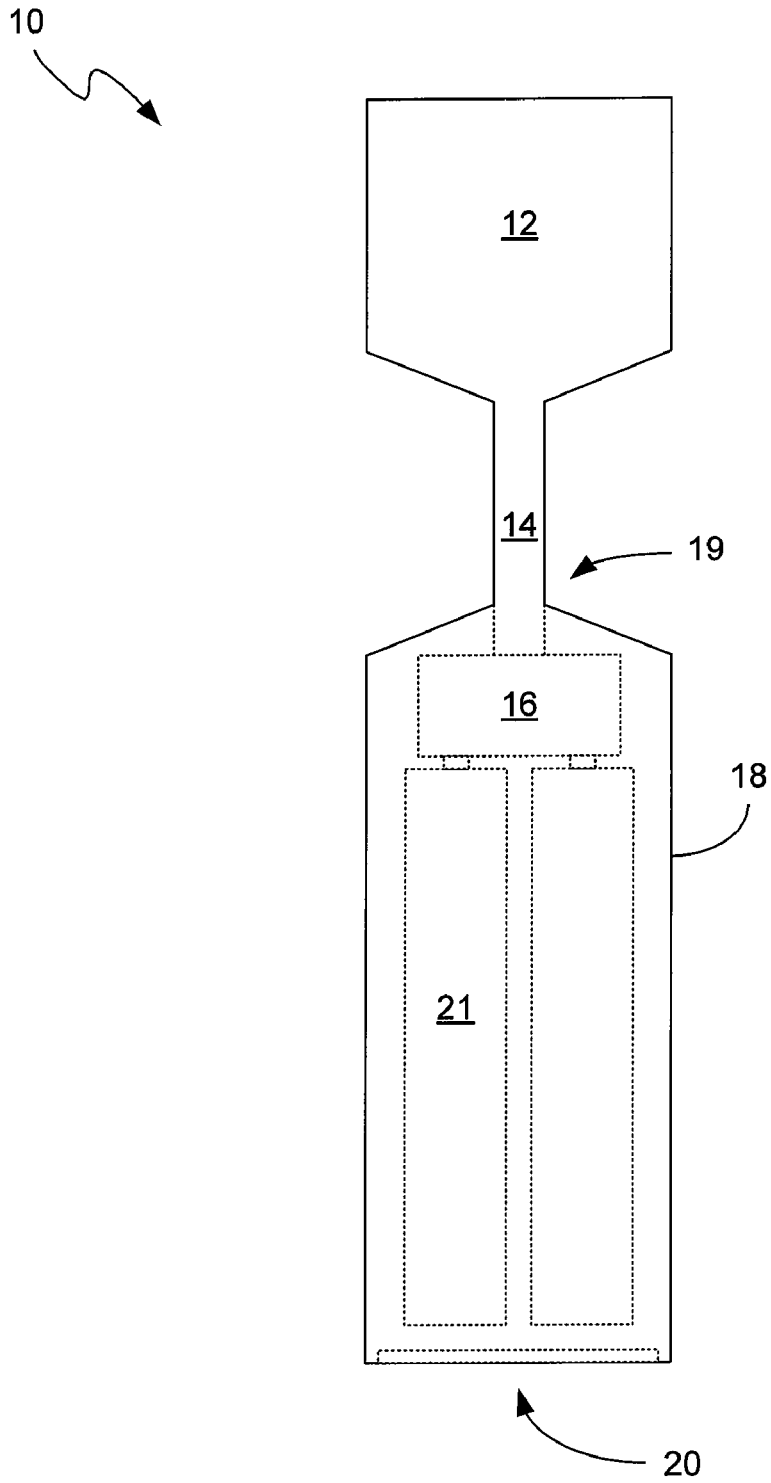
FIG. 1 is a front view of an embodiment of a louver sander.

An embodiment of a Louver Sander is depicted in FIG. 1. As shown in FIG. 1, the Louver Sander 10 includes: a sanding paddle (12) with sanding grit; a staff (14) connecting into the base component (or battery housing 18) that snaps into place at the top of the vibrator motor (16); location of entry (19) of the paddle into the base (handle); a vibrator motor (16) that the staff snaps into; two batteries (e.g., battery 21) providing 14 volts of power to the vibrator mechanism housed in the base; and the entry location (20) for the batteries to enter.

Figure 2:
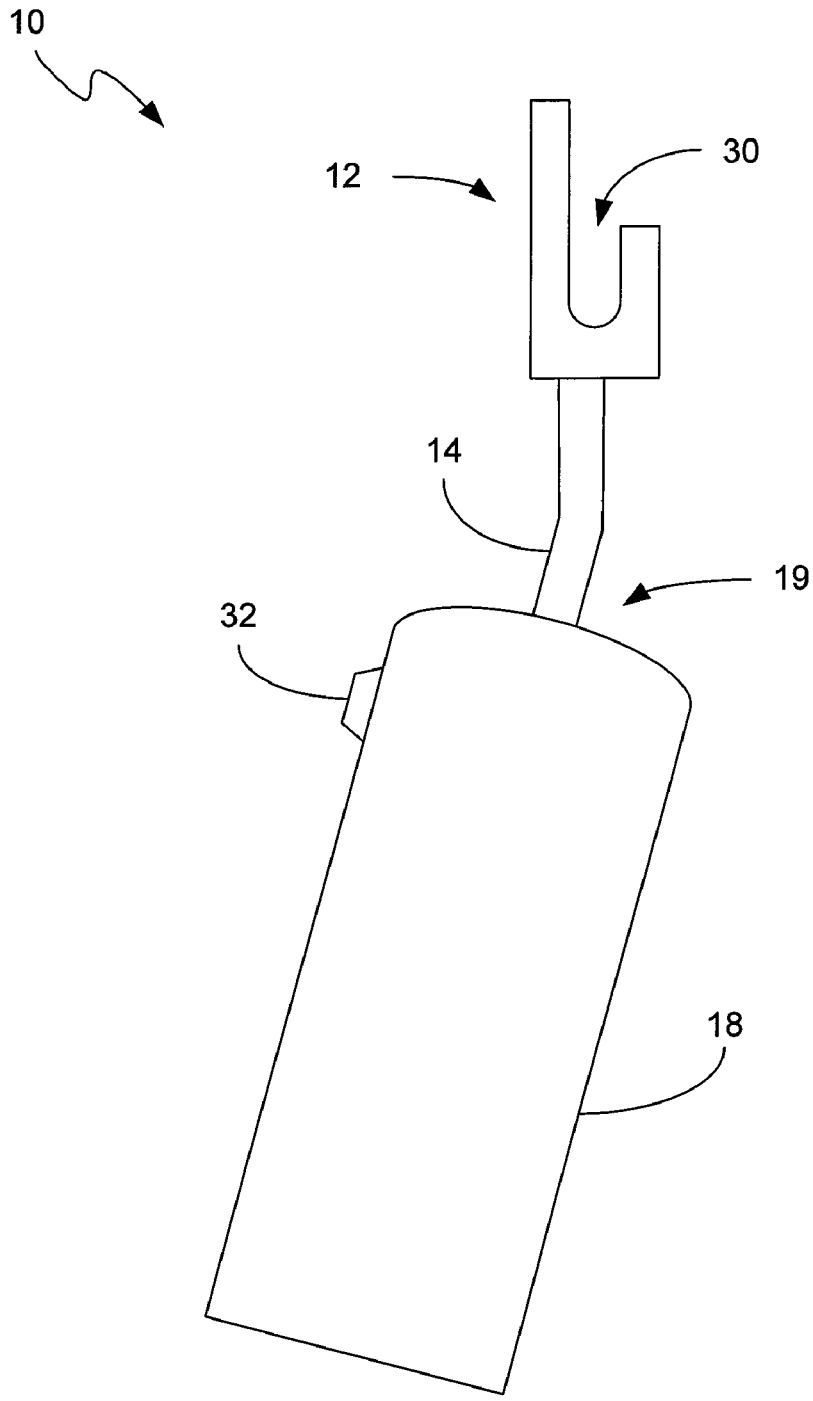
FIG. 2 is a side view of the embodiment of the louver sander of FIG. 1.

FIG. 2 is a right side view of the Louver Sander of FIG. 1 showing: a location (30) where the louver would be positioned to sand; the sanding paddle with grit positioned to sand the louver once it is on position (30); the staff (14) of the sanding paddle; the location of entry (19) into the base where staff snaps into vibrator mechanism; three speed button (32) to turn on the vibrator; and the housing component (18) which contains the batteries and vibrator mechanism.

Note that grit can be located on all surfaces of the paddle.

The invention claimed is:

1. A louver sander for sanding a louver having a first surface and a second surface opposing the first surface, said louver sander comprising:

a housing containing a vibrator motor; and a sanding attachment having a staff and a sanding paddle;

the staff being sized and shaped to be removably attached to the housing;

the sanding paddle being located at a distal end of the staff such that when the staff is attached to the housing and the vibrator motor is operating, the sanding paddle is vibrated;

the sanding paddle having a first sanding surface, comprising a sanding grit, a second sanding surface, comprising a sanding grit; and a curved sanding surface interconnecting the first sanding surface, comprising a sanding grit, the curved sanding surface and the second sanding surface, the first sanding surface and the second sanding surface facing each other and being operative to sand a louver such that positioning of the sanding attachment with the louver located between the first sanding surface and the second sanding surface causes the first sanding surface to be positioned adjacent to and faced towards the first surface of the louver and the second sanding surface to be positioned adjacent to and faced towards the second surface of the louver;

the first sanding surface extending outwardly from the curved surface to a length that is greater than a length that the second sanding surface extends from the curved surface, the length of the first sanding surface being positioned to sand the first surface of the louver while the length of the second sanding surface is positioned to sand the second surface of the louver.

2. The louver sander of claim 1, wherein the staff incorporates a bend such that the paddle is inclined with respect to a longitudinal axis of a first portion of the staff that interconnects with the housing.

3. The louver sander of claim 1, wherein:

the louver sander further comprises a battery operative to power the vibrator motor; and the housing defines a battery compartment sized and shaped to receive the battery.

4. The louver sander claim 1, wherein the first sanding surface and the second sanding surface are parallel to each other.

5. The louver sander of claim 1, wherein the first sanding surface exhibits a rectangular periphery.

6. The louver sander of claim 1, further comprising a three-speed switch operative to selectively vibrate the paddle at a selected one of three speeds.

7. The louver sander of claim 1, further comprising means for selectively vibrating the paddle at a selected speed.

8. The louver sander of claim 1, wherein the entire outer surface of the sanding paddle is covered in sanding grit.

9. The louver sander of claim 1, wherein:

the sanding attachment is a first sanding attachment; and the louver sander further comprises a second sanding attachment having a second staff and a second sanding paddle.

10. The louver sander of claim 9, wherein the second staff is sized and shaped to be removably attached to the housing.

11. The louver sander of claim 9, wherein the second sanding paddle has first and second opposing sanding surfaces and a curved surface interconnecting the first and second surfaces.

12. The louver sander of claim 9, wherein the first sanding surface of the second sanding paddle extends outwardly from the curved surface of the second sanding paddle to a length that is greater than a length that the second sanding surface of the second sanding paddle extends from the curved surface of the second sanding paddle.

* * * * *